US008821367B2

(12) United States Patent
Khodak

(10) Patent No.: US 8,821,367 B2
(45) Date of Patent: Sep. 2, 2014

(54) WARMING THERAPY DEVICE INCLUDING ROTATABLE MATTRESS TRAY

(75) Inventor: Andrei Khodak, Hatfield, PA (US)

(73) Assignee: Draeger Medical Systems, Inc., Telford, PA (US)

( * ) Notice: Subject to any disclaimer, the term of this patent is extended or adjusted under 35 U.S.C. 154(b) by 428 days.

(21) Appl. No.: 12/738,785

(22) PCT Filed: Nov. 18, 2008

(86) PCT No.: PCT/US2008/083892

§ 371 (c)(1), (2), (4) Date: Apr. 19, 2010

(87) PCT Pub. No.: WO2009/073355

PCT Pub. Date: Jun. 11, 2009

(65) Prior Publication Data

US 2010/0249492 A1 Sep. 30, 2010

Related U.S. Application Data

(60) Provisional application No. 61/005,294, filed on Dec. 4, 2007, provisional application No. 61/106,743, filed on Oct. 20, 2008.

(51) Int. Cl.
*A61G 11/00* (2006.01)
*A61G 7/10* (2006.01)

(52) U.S. Cl.
CPC ..... *A61G 11/00* (2013.01); *A61G 2200/32* (2013.01); *A61G 11/005* (2013.01); *A61G 7/1076* (2013.01)
USPC ..... 600/22

(58) Field of Classification Search
USPC ..... 600/22; 5/610, 655
See application file for complete search history.

(56) References Cited

U.S. PATENT DOCUMENTS

| | | | | |
|---|---|---|---|---|
| 3,158,150 | A | 11/1964 | Croasdaile | |
| 3,326,203 | A | 6/1967 | Goertzel | |
| 5,067,188 | A | 11/1991 | Brantman | 5/81 |
| 6,027,170 | A | 2/2000 | Benz et al. | 297/344.21 |
| 6,074,340 | A | 6/2000 | Sweeney et al. | 600/22 |
| 6,155,970 | A | 12/2000 | Dykes et al. | 600/22 |
| 6,241,314 | B1 | 6/2001 | Pufall | 297/256.12 |
| 6,354,550 | B2 | 3/2002 | Jeong | 248/299.1 |
| 6,880,188 | B1 | 4/2005 | Schmidt et al. | 5/603 |
| 7,219,961 | B2 | 5/2007 | Priepke et al. | 297/344.21 |
| 2004/0236174 | A1 | 11/2004 | Boone et al. | 600/21 |

FOREIGN PATENT DOCUMENTS

| | | | | |
|---|---|---|---|---|
| CN | 1256587 | A | 6/2000 | H04N 5/64 |
| GB | 1161817 | | 8/1969 | A61G 11/00 |

OTHER PUBLICATIONS

Chinese Office Action dated Jul. 2, 2012.
Search Report dated Oct. 21, 2013 in co-pending European Appln. No. 08858139.2.

*Primary Examiner* — Christine Matthews
(74) *Attorney, Agent, or Firm* — DLA Piper LLP (US)

(57) ABSTRACT

An apparatus and method for providing patient access in a warming therapy device (e.g., incubator, warmer, etc.) is described. In one exemplary embodiment, the apparatus includes a mattress tray assembly having at least two axes of rotation, and in another exemplary embodiment, the apparatus includes a mattress tray assembly having at least four axes of rotation.

11 Claims, 15 Drawing Sheets

WARMING THERAPY DEVICE INCLUDING ROTATABLE MATTRESS TRAY

CROSS REFERENCE TO RELATED APPLICATIONS

This application is a §371 of International Application No. PCT/US08/83892, filed Nov. 18, 2008 (WO 2009/073355, published Jun. 11, 2009), which claims priority to U.S. Provisional Patent Application No. 61/005,294, filed Dec. 4, 2007, and U.S. Provisional Patent Application No. 61/106,743, filed Oct. 20, 2008, the entire contents of which are incorporated herein by reference, as if fully set forth herein.

FIELD OF THE INVENTION

The present invention relates generally to a method and apparatus for providing patient access in a warming therapy device (e.g., incubator, warmer, etc.). More particularly, the present invention relates to a method and apparatus for permitting rotation of a patient mattress to various positions in elation to the warming therapy device.

BACKGROUND OF THE INVENTION

Infant care units, such as warming therapy devices (e.g., incubators, warmers, etc.) that includes various systems for controlling the temperature and humidity to facilitate the development of a premature infant, are known. Such devices conventionally include an infant support surface for supporting an infant, as well as means of protecting the infant, such as a hood or canopy which covers the infant support surface.

It is typical in such devices to provide access to the infant. For example, side panels may be provided with access openings through which caregivers gain access to the infant. Such devices may also include hoods that have access doors to provide further access to the infant. It is also known for the hoods of such devices to be movable away from the infant support surface, and for the side panels of such units to be movable away from the infant support surface to provide still further access to the infant.

For example, U.S. Pat. No. 6,880,188, the disclosure of which is hereby incorporated by reference in this application as if fully set forth herein, discloses an infant care apparatus with a movable infant support. The infant support is slideable along rails from a central position, to positions offset born the central position (See FIGS. 5-7). However, the infant care apparatus does not allow rotation of the mattress, which limits the types of examinations that can be performed by the care giver. For example, if the right side of the infant patient (200) needs to be examined, the movable infant support (21) must be moved to the right-hand side position of the infant care apparatus (shown in FIG. 7), which requires lowering of the right-hand side panel (144). If then, the left side of the infant patient (200) needs to be examined, the movable infant support (21) must be moved to the left-hand side position of the infant care apparatus (shown in FIG. 6), which requires lowering in the right-hand side panel (122), and so forth. In practice, infant patients are not typically examined from one side or another, and therefore access to the entire body of the infant would be preferable.

It would be beneficial to further improve a caregiver's access to an infant patient disposed on an infant support of a warming therapy device. It would also be beneficial to provide convenient access to the infant support flit maintenance and cleaning purposes. Accordingly, there is presently a need for a warming therapy device with an infant support which is moveable in various directions to permit access to the entire body of an infant.

SUMMARY OF THE INVENTION

An exemplary embodiment of the present invention comprises an apparatus including a patient support assembly and a mattress tray assembly coupled to the patient support assembly, the mattress tray assembly comprising a mattress tray and a support base, the mattress tray being moveable within the support base about at least two axes of rotation.

An exemplary embodiment of the present invention also comprises a warming therapy device including a patient support assembly, a mattress tray assembly coupled to the patient support assembly, the mattress tray assembly comprising a mattress tray and a support base, the mattress tray being moveable within the support base about at least two axes of rotation, and a hood coupled to the patient support assembly, said hood including at least one sidewall.

An exemplary embodiment of the present invention also comprises an apparatus including a mattress tray and a support base, wherein the mattress tray is moveable within the support base about at least two axes of rotation to at least first and second positions, the first position being substantially centered on the support base, and the second position being located laterally, on one side of the first position.

DETAILED DESCRIPTION

The present invention relates to a warming therapy device (e.g., incubator, warmer, etc.) including a mattress tray assembly with a rotatable mattress tray. In a first exemplary embodiment, the mattress tray assembly includes at least two grooves for permitting rotation of a mattress tray about at least two (2) axes of rotation. In a second exemplary embodiment, the mattress tray assembly includes at least two (2) guides for guiding rotation of a mattress tray about at least two (2) axes of rotation. In a third exemplary embodiment, the mattress tray assembly includes at least four (4) grooves for permitting rotation of a mattress tray about at least tour (4) axes of rotation. In both the first and third exemplary embodiments described above the mattress tray rotates about at least two (2) axes of rotation. One advantage of using two axes of rotation is the ability to rotate the mattress tray up to ninety degrees (90°) with only one side of the hood of the warming therapy device open, as shown in FIG. 2 of the present application.

Several of the exemplary embodiments of the present invention comprise mattress trays which can rotate relative to a support base around one (1) or more axes which are shifted relatively to the axis of symmetry of the support base. Positioning the axes of rotation in this manner allows positioning of the mattress tray so as to be more accessible for the caregiver with only one sidewall of the warming therapy device opened. Additionally, several of the exemplary embodiments of the present invention comprise means to keep the mattress tray attached to the support base when mattress tray is rotating. Further several of the exemplary embodiments of the present invention comprise means to support hoses, cables and other medical related paraphernalia, so that such members do not need to be removed from the patient during rotation of the mattress tray.

Figure 1:
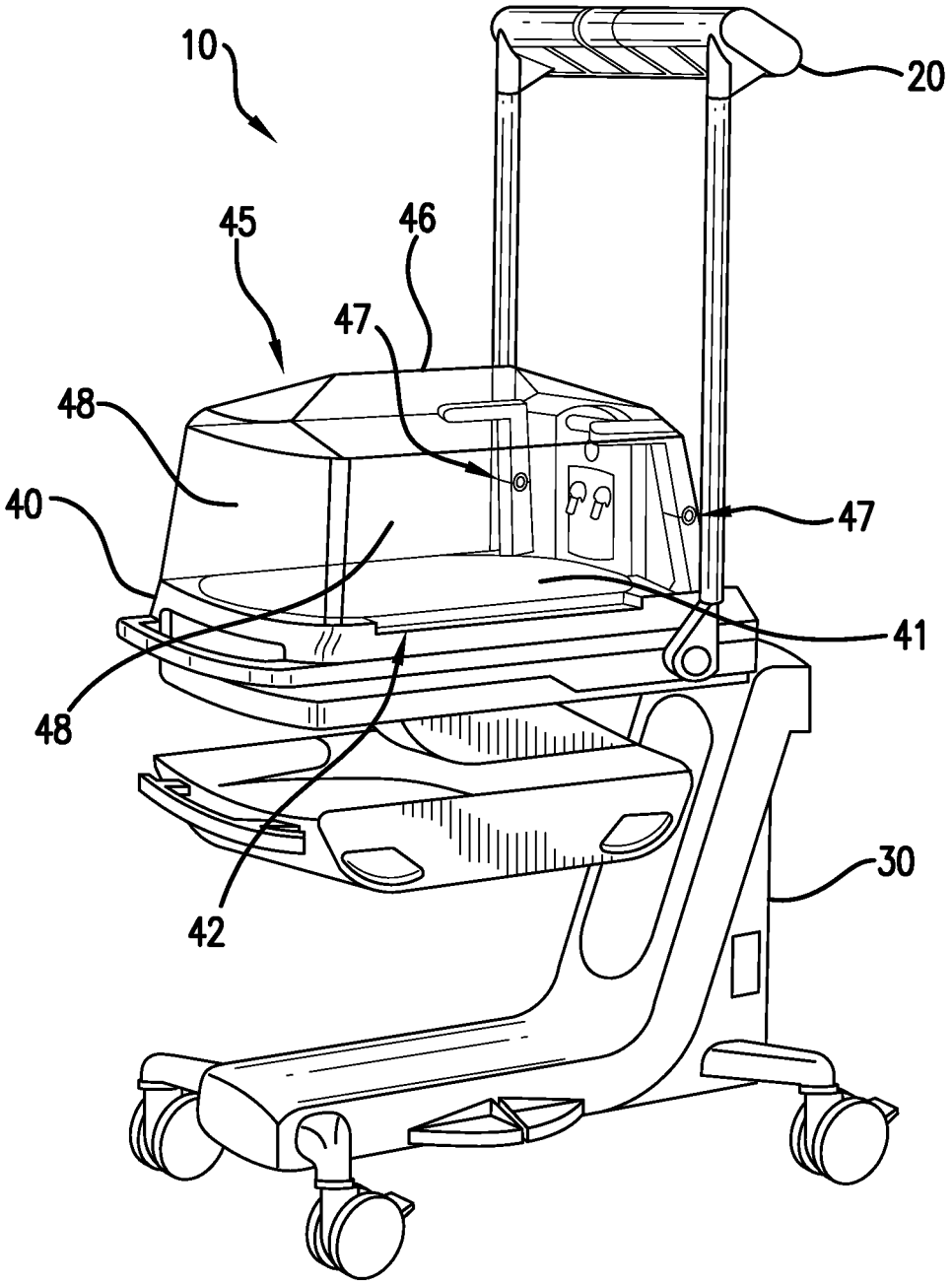
FIG. 1 is perspective view of an warming therapy device according to a first exemplary embodiment of the present invention.
Figure 2:
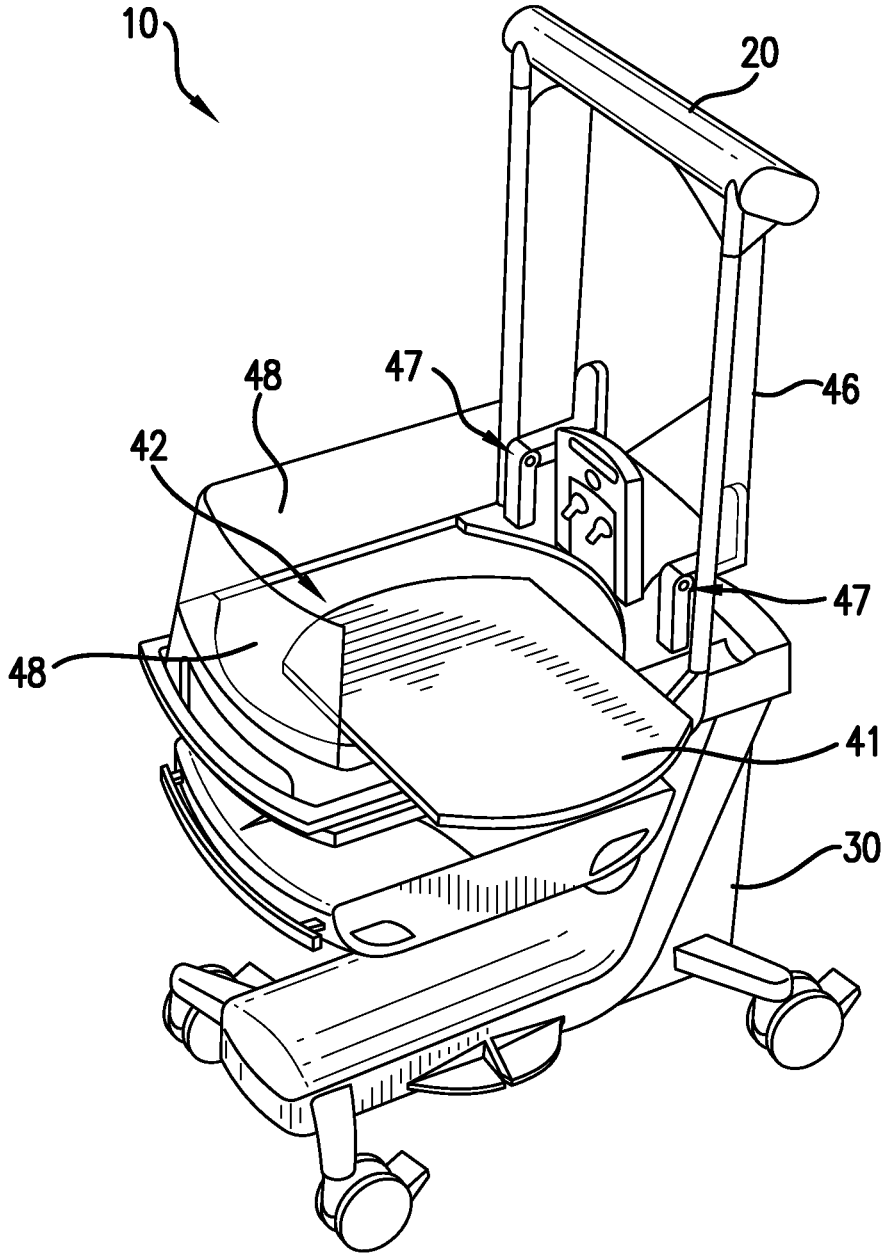
FIG. 2 is a perspective view of the warming therapy device shown in FIG. 1 with a mattress tray rotated ninety degrees.

FIGS. 1 and 2 show a warming therapy device 10 according to a first exemplary embodiment of the present invention. The warming therapy device 10 includes a radiant heater head 20, and a patient support assembly 30 including a mattress tray assembly 40. The mattress tray assembly 40 may include as hood 45 which has a top portion 46 which pivots about one or more axes 47. The hood 45 may also include one or more sidewalls 48 which may be slideable, removable, pivotable or rotatable. The mattress tray assembly 40 includes a mattress tray 41 disposed within a recessed support base 42. As explained in detail below with reference to other exemplary embodiments, the mattress tray 41 is rotatable within the support base 42 up three hundred and sixty degrees (360°). FIG. 2 specifically shows the mattress tray 41 rotated approximately ninety degrees (90°) with respect to the position shown in FIG. 1.

Figure 3:
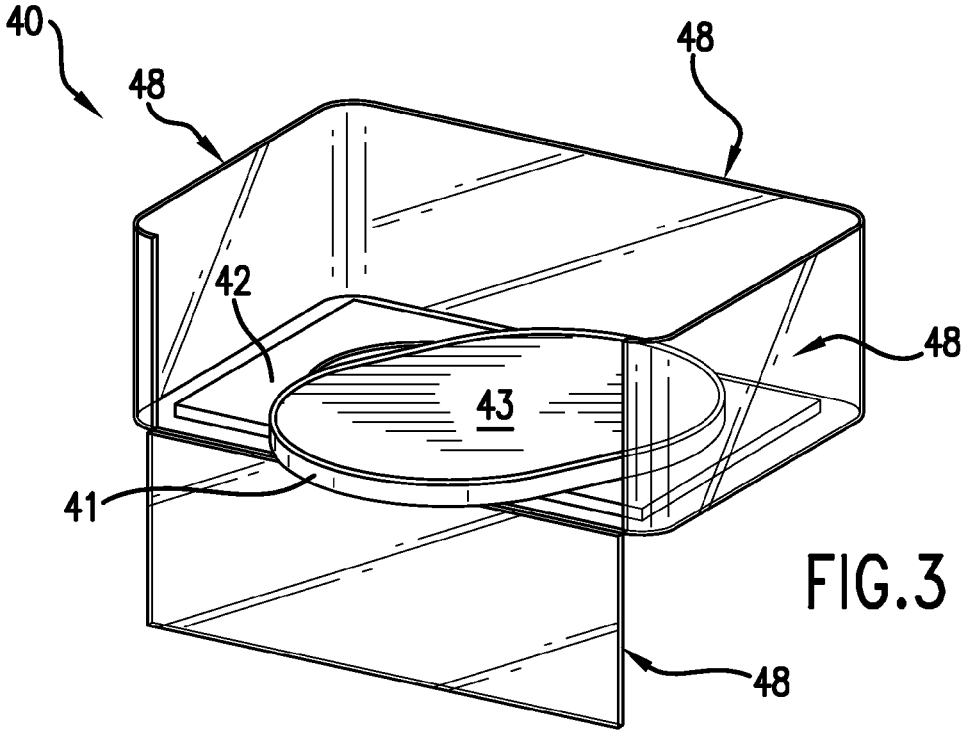
FIG. 3 is a perspective view of a mattress tray assembly according to a first exemplary embodiment of the present invention.

FIG. 3 shows the mattress tray assembly 40 according to the first exemplary embodiment of the present invention. The mattress tray assembly 40 includes a mattress 43 disposed within a mattress tray 41, a support base 42, and a hood comprised partially of respective side walls 48. The side walls 48 are designed to prevent a patient disposed on the mattress 43 from falling off the mattress tray assembly 40. Each of the side walls 48 may be slid, removed, pivoted end/or rotated so as to create room to rotate the mattress tray 41. As shown in FIG. 3, the forward side wall 48 has been moved downward to make room for the mattress tray 41 to rotate.

Figure 4:
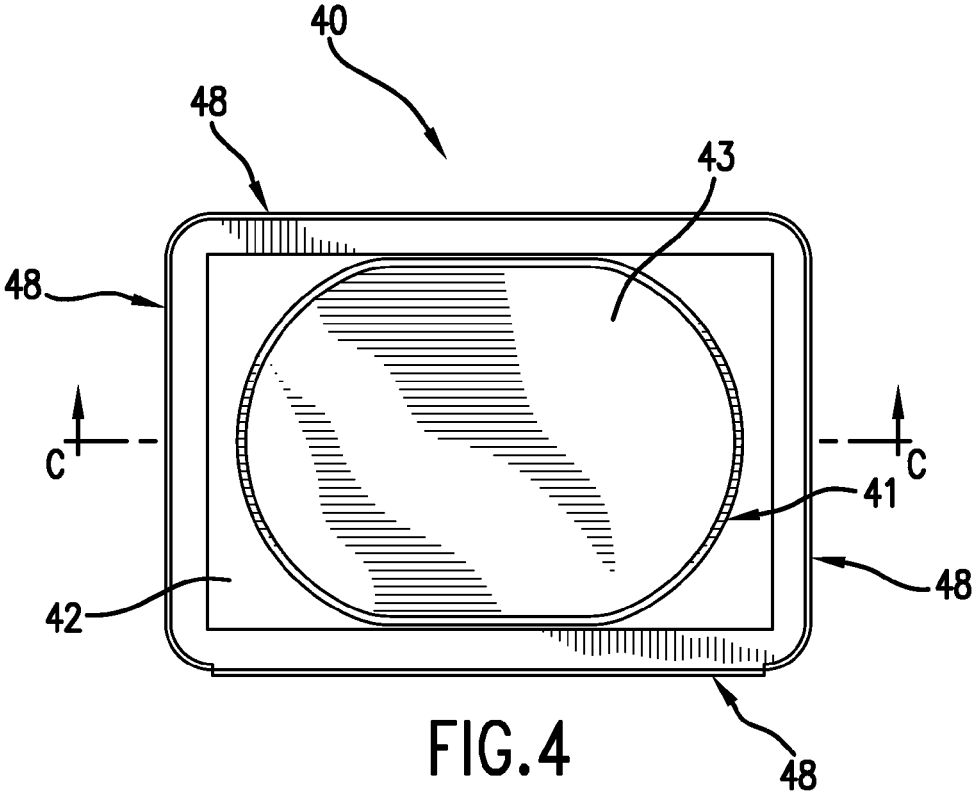
FIG. 4 is a top view of the mattress tray assembly shown in FIG. 3.
Figure 5:
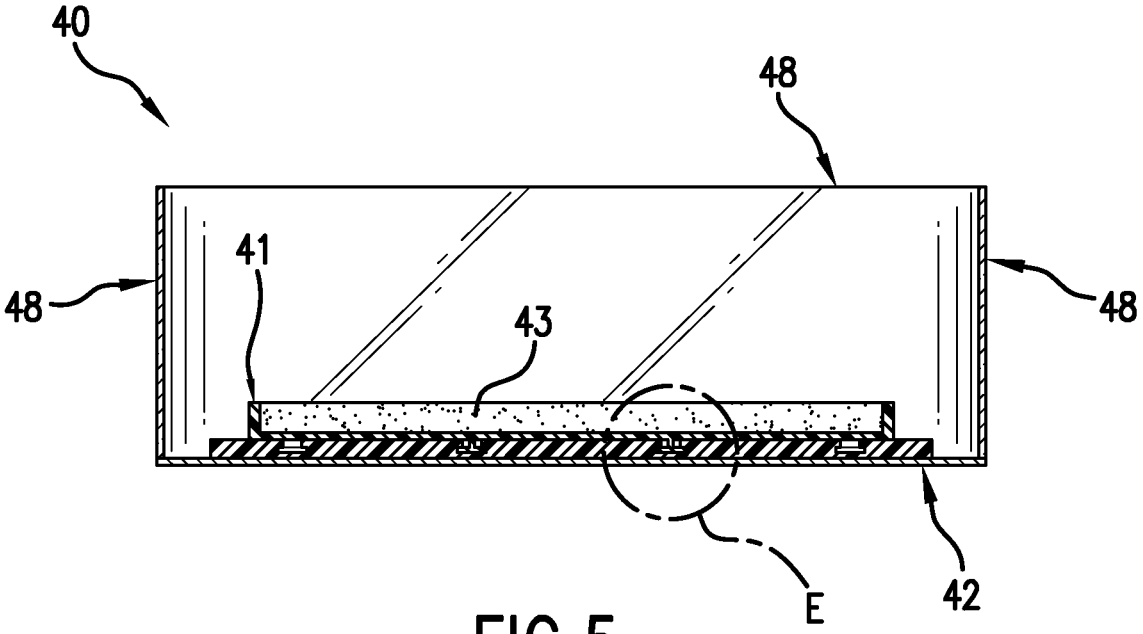
FIG. 5 is a cross-section of the mattress tray assembly shown in FIG. 4, taken along lines C-C.

FIG. 4 is a top view of the mattress tray assembly 40 shown in FIG. 3, and FIG. 5 shows a cross-section of the mattress tray assembly 40, taken along lines C-C in FIG. 4. FIG. 4 shows the mattress tray 41 of the mattress tray assembly 40 in a 'central' or aligned position, where the mattress tray is disposed completely above the support base 42. FIG. 5 is a side view of the mattress tray assembly 40 which shows some details of the interface between the mattress tray 41 and support base 42, which will be described in greater detail with reference to FIG. 6 below.

Figure 6:
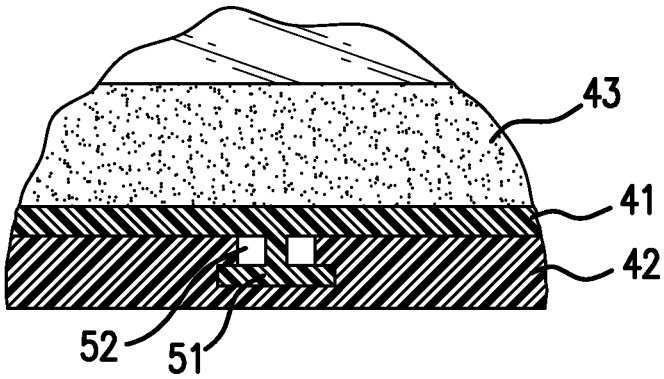
FIG. 6 is a detail front cross-sectional view of the mattress tray assembly shown in FIG. 5, taken detail circle E.

FIG. 6 shows a detail front cross-sectional view of the mattress tray assembly 40, taken along detail area 'E' in FIG. 5, which shows the mattress 43, mattress tray 41, and support base 42. As shown in FIG. 6, the bottom side of the mattress tray 41 includes pins 51 coupled thereto which engage with grooves 52 in the support base 42. These pins 51 may be circular (as shown in FIG. 6), or may be of any other suitable shape known to those of ordinary skill in the art. Similarly, the grooves 52 may be circular (as shown in FIG. 6), or may be of any other suitable shape known to those of ordinary skill in the art.

Figure 7:
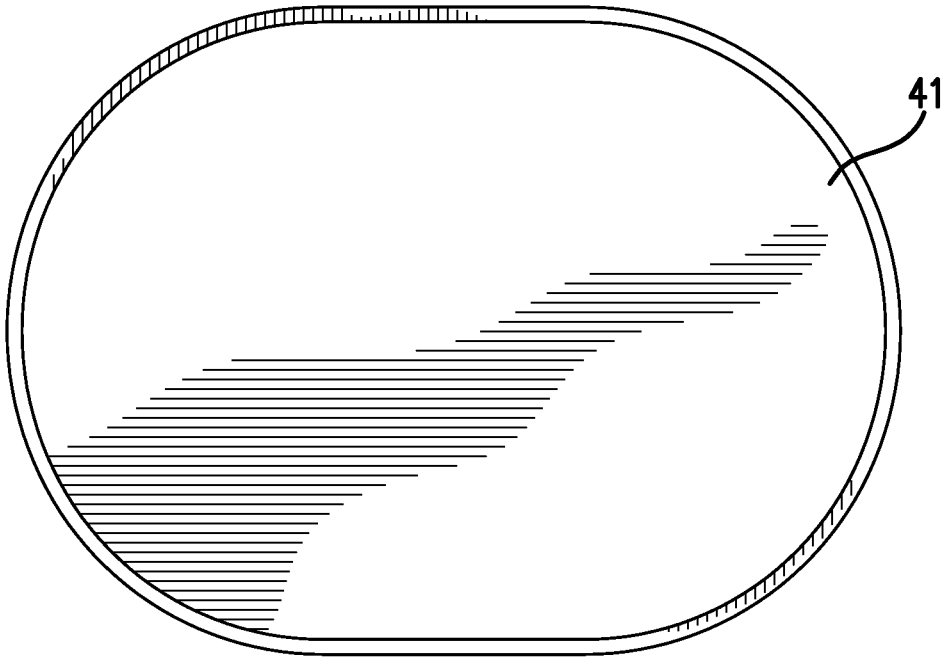
FIG. 7 is a top view of a mattress tray according to the first exemplary embodiment of the present invention.
Figure 8:
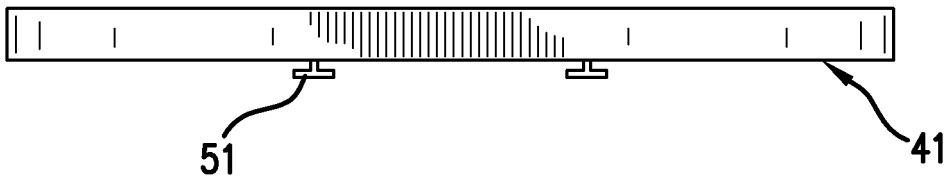
FIG. 8 is a side view of the mattress tray shown in FIG. 7.
Figure 9:
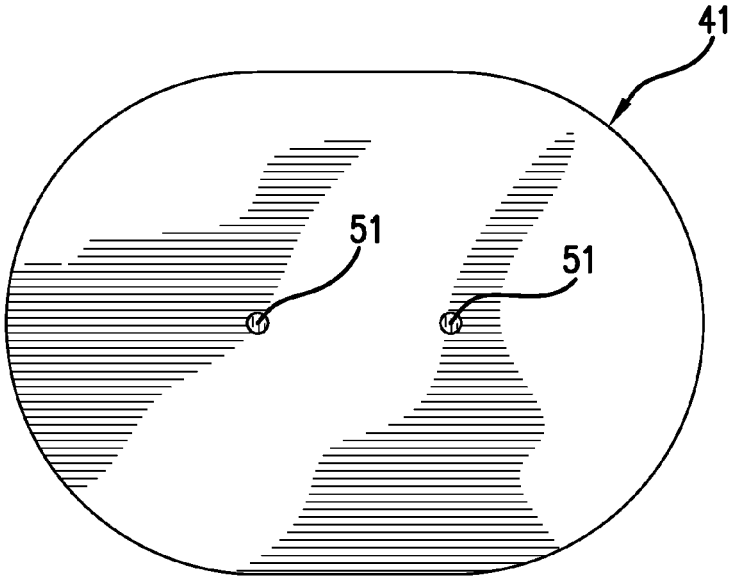
FIG. 9 is a bottom view of the mattress tray shown in FIG. 7.

FIGS. 7-9 show top, side and bottom views, respectively, of the mattress tray 41 shown in FIGS. 3-6. FIG. 7 shows that the mattress tray 41 as being substantially oval shape, however, those of ordinary skill in the art will realize that the mattress tray may be of any suitable shape. FIG. 8 is a side view of the mattress tray 41 showing the pins 51 coupled to the bottom side of the mattress tray. FIG. 9 is a bottom view of the mattress tray 41 showing the location of the pins 51. Particularly, the pins 51 are disposed centrally on the mattress tray 41.

Figure 10:
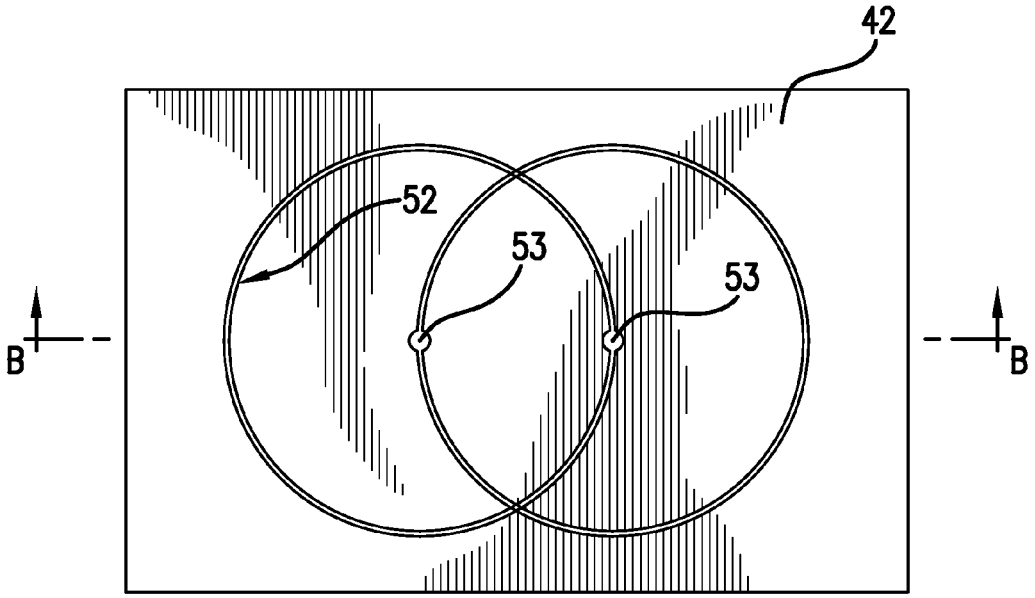
FIG. 10 is a top view of a support base according, to a first exemplary embodiment of the present invention.
Figure 11:
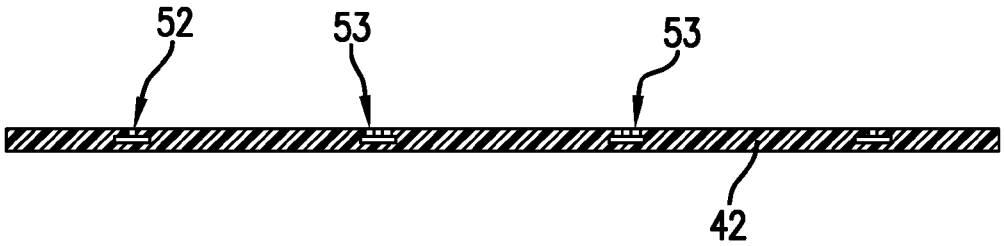
FIG. 11 is a side view of the support base shown in FIG. 10.
Figure 12:
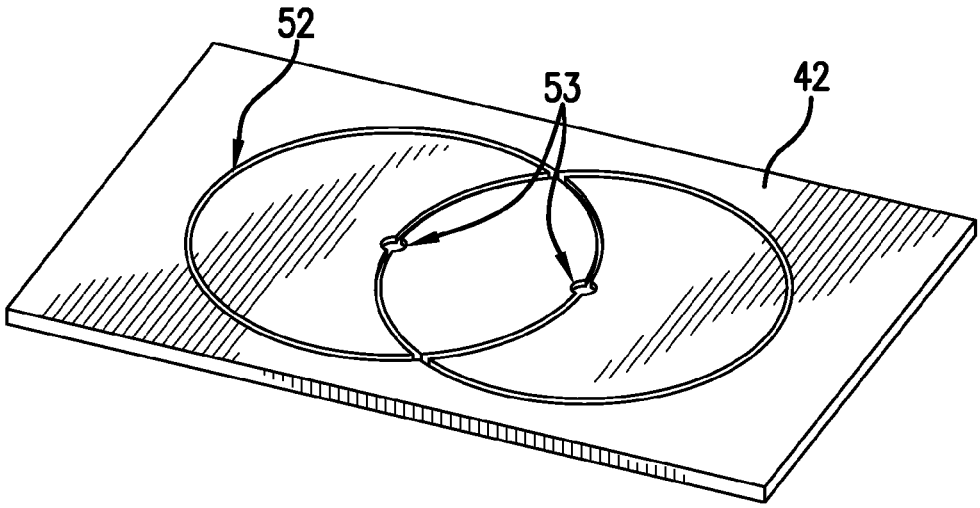
FIG. 12 is a perspective view of the support base shown in FIG. 10.

FIGS. 10-12 show top, side cross-section, and perspective views, respectively, of the support base 42 shown in FIGS. 3-6. FIG. 10 is a top view of the support base 42 showing its substantially rectangular shape and the circular grooves 52 disposed therein. FIG. 10 also shows openings 53 formed in the grooves 52. The openings 53 in the grooves 52 may be circular (as shown in FIG. 10), or may be of any other suitable shape known to those of ordinary skill in the art. Preferably, the openings correspond in shape to the shape of the pins 51 (e.g., they are both circular), to allow the pins to be inserted into the support base 42. In this manner, the mattress tray 41 can be removed from the support base 42 only when the pins 51 are rotationally aligned with the openings 53 in the grooves 52. Preferably, the openings 53 are disposed at the position where the pins 51 would be disposed when the mattress tray 41 is in its 'central' or aligned position (as shown, for example, in FIGS. 1 and 4 of the present application). Accordingly, when the mattress tray 41 is rotated within the support base 42, the pins 51 will no longer align with the openings 53 in the grooves 52, and thus will prevent removal of the mattress tray.

FIG. 11 is a side cross-sectional view of the support base 42, taken along lines B-B in FIG. 10, which shows the relative position of the grooves 52 and openings 53. FIG. 12 is to perspective view rd support base 42 which again shows the relative position of the grooves 52 and openings 53. Particularly, the openings 53 are disposed centrally on the mattress tray 41, corresponding to the position of the pins 51 shown in FIG. 9.

Figure 13:
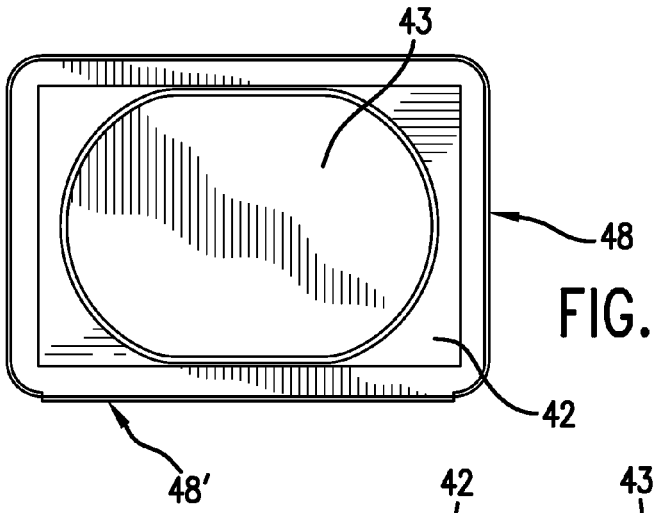
FIG. 13 is a top view of the mattress tray assembly according to the first exemplary embodiment of the present invention, where the mattress tray is disposed in a central position.
Figure 14:
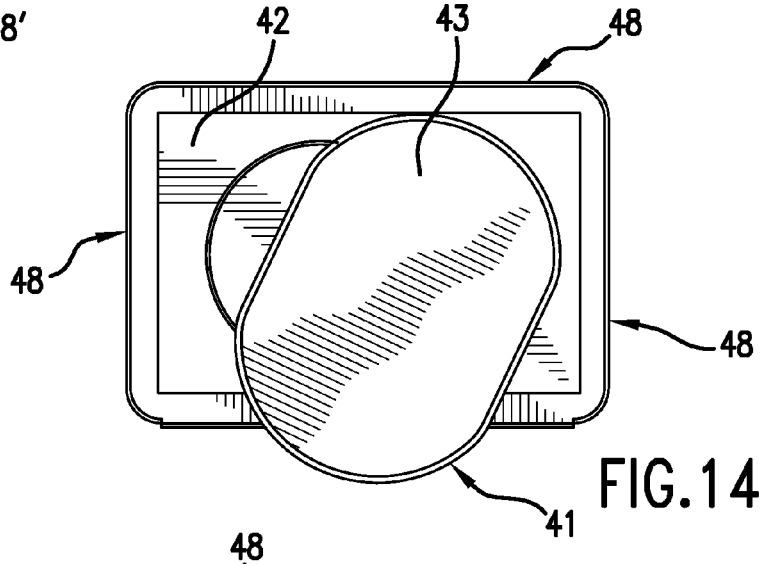
FIG. 14 is a top view of the mattress tray assembly shown in FIG. 13, where the mattress tray is disposed in a first rotated position.
Figure 15:
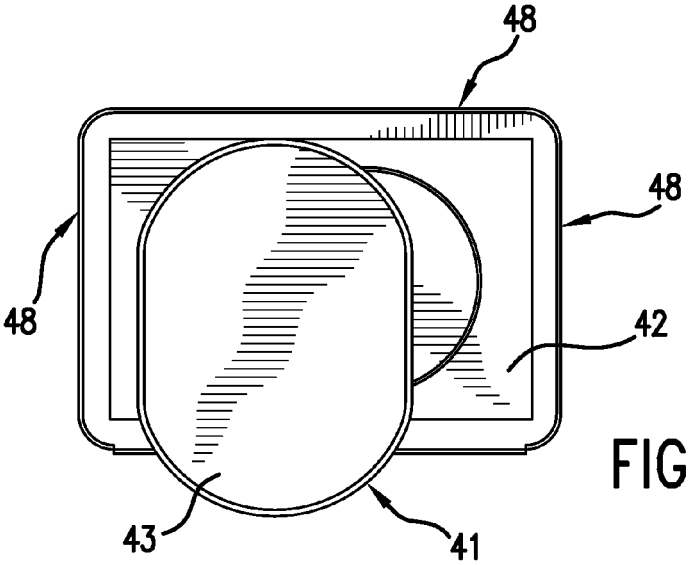
FIG. 15 is a top view of the mattress tray assembly shown in FIG. 13, where the mattress tray is disposed in a second rotated position.

FIGS. 13-15 show respective top views of the mattress tray assembly 40 in various states of rotation. FIG. 13 shows the mattress tray 41 in a 'central' or aligned position. FIG. 14 shows the mattress tray 41 in a first rotated position where the tray is disposed somewhere between zero degrees (0°) and ninety degrees (90°) with respect to the 'central' position. FIG. 15 glows the mattress tray 41 in a second rotated position where the tray is disposed at ninety degrees (90°) with respect to the 'central' position. As noted above, the mattress tray 41 may be rotated up to three hundred and sixty degrees (360°) with respect to the 'central' position, and thus the above-referenced positions are not the only positions of the mattress tray. Of course, one or more of the side walls 48 must be removed, pivoted or rotated in order to achieve full 360 rotation. In FIGS. 13-15, side wall 48' (shown in FIG. 13) has been removed, and the sidewalls 48 remain.

Figure 16:
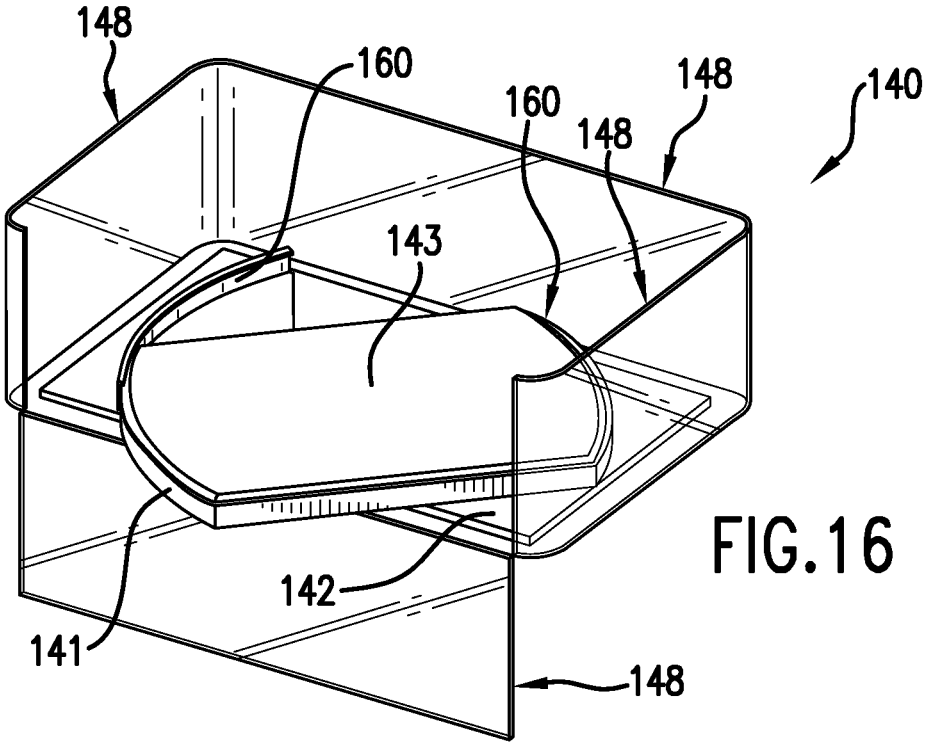
FIG. 16 is a perspective view of a mattress tray assembly according to a second exemplary embodiment of the present invention.

FIG. 16 shows a perspective view of a mattress tray assembly 140 according to a second exemplary embodiment of the present invention. The mattress tray assembly 140 includes a mattress 143 disposed within a mattress tray 141, a support base 142, and a hood comprised partially of respective, side walls 148. The side walls 148 are designed to prevent a patient disposed on the mattress 143 from falling off the mattress tray assembly 140. Each of the side walls 148 may be slid, removed, pivoted and/or rotated so as to create room to rotate the mattress tray 141.

As opposed to the mattress tray assembly 40 shown in FIGS. 3-15 (and described above), the mattress tray assembly 140 includes a mattress tray 141 which is aligned with at least two (2) guides 160 coupled to the support base 142. The guides 160 may be semi-circular (as shown in FIG. 16), or may be of any other suitable shape known to those of ordinary skill in the art. However, the shape of the guides 160 should conform to the outer dimension of the mattress tray 141, to allow the mattress tray to rotate or slide within the guides.

Figure 17:
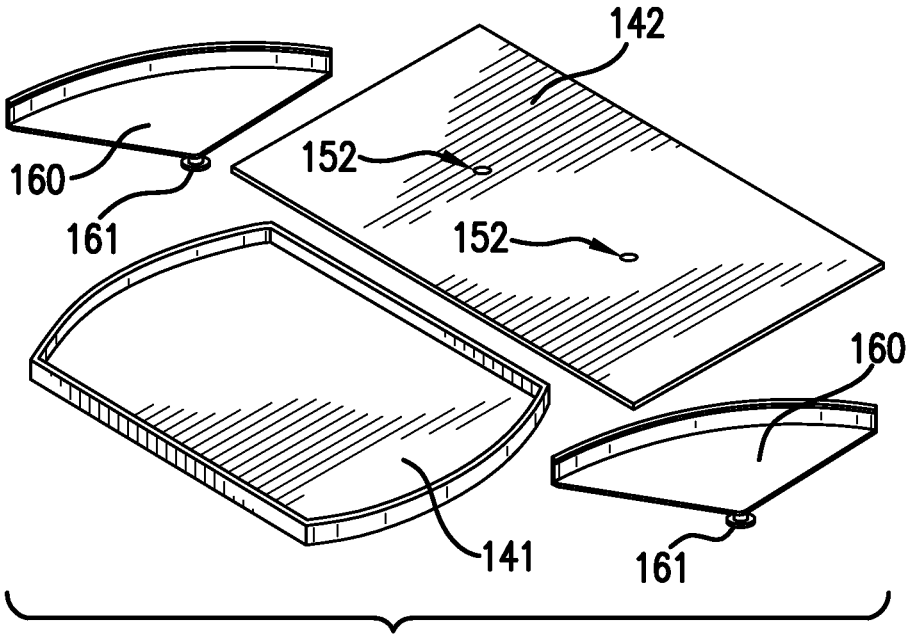
FIG. 17 is an exploded perspective view of a portion of the mattress tray assembly shown in FIG. 16.

FIG. 17 shows an exploded perspective view of a portion of the mattress tray assembly 140. The support base 142 includes grooves 152 disposed therein which tire adapted to receive pins 161 coupled to the guides 160. As in the first exemplary embodiment described above, the second exemplary embodiment rotates about two (2) axes of rotation (i.e., the as formed by the grooves 152 which underlie the pin 161). The mattress tray 141 can rotate three hundred sixty degrees (360) about the two axes of rotation of die guides 160. In particular, one end of the mattress tray 141 may slide along the outer edge of on of the guides 160, and the other end of the mattress tots trots rotate within the other of the guides 160 to achieve one hundred eighty degree (180) rotation in a first direction. In the exemplary embodiment shown in FIG. 16, the mattress tray 141 may slide along the edge of the guide 160 shown on the left-hand side of the figure, and may rotate within the guide 160 shown on the right-hand side of the figure, to achieve one hundred eighty degree (180) rotation in a first direction. The mattress tray 141 ma similarly slide along the edge of the guide 160 shown on the right-hand side of FIG. 16, and rotate within the guide 160 shown on the left-hand side of the figure, to achieve one hundred eighty degree (180) rotation in a second (opposing) direction. Together, the two axes of rotation provided by the guides 160 allow three hundred sixty degrees (360) of rotation.

Figure 18:
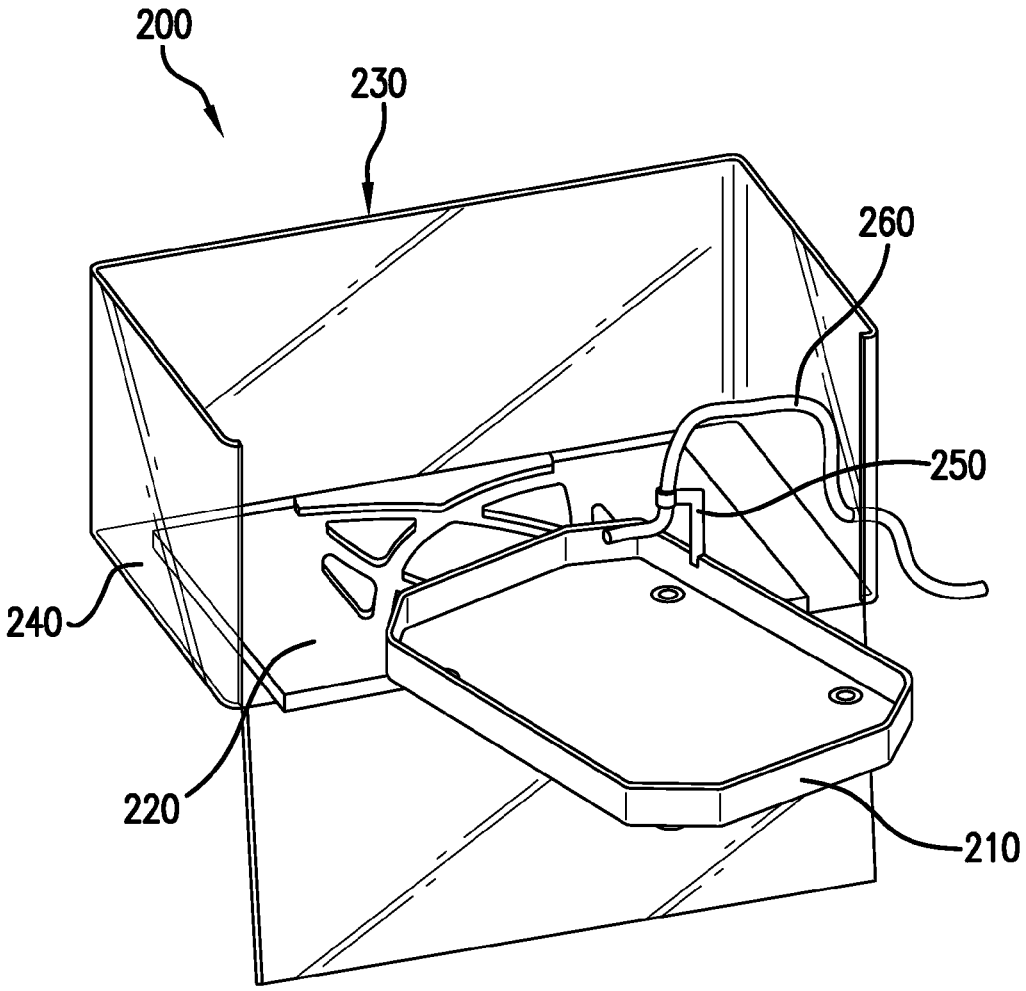
FIG. 18 is a perspective view of a mattress tray assembly according to a third exemplary embodiment of the present invention.
Figure 19A:
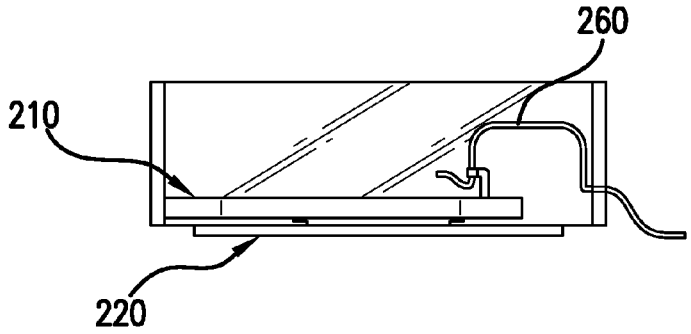
FIG. 19A is a side view of the mattress tray assembly shown in FIG. 18.
Figure 19B:
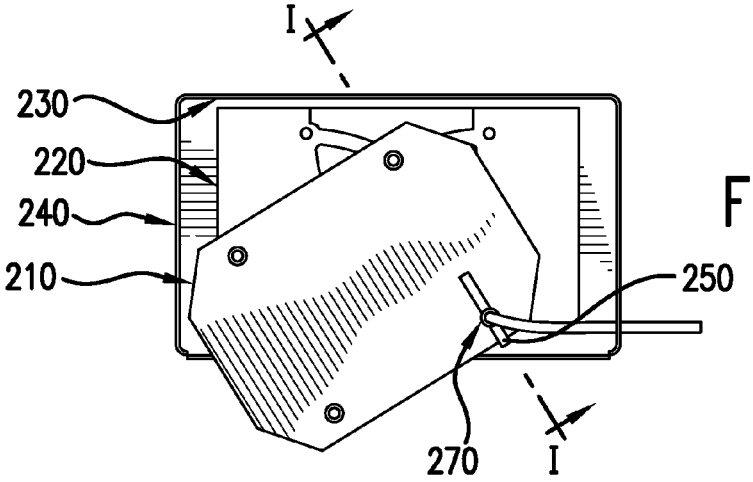
FIG. 19B is a top view of the mattress tray assembly shown in FIG. 18.
Figure 19D:
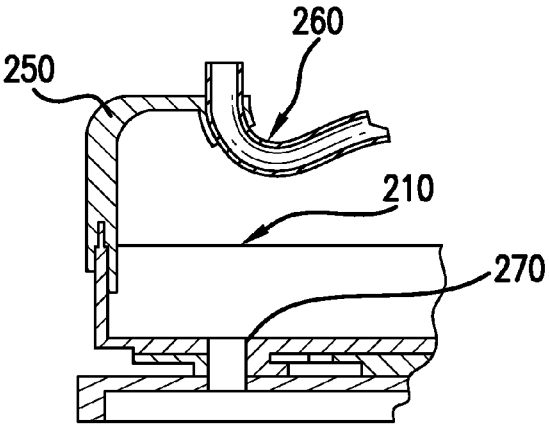
FIG. 19D is a detail side cross-sectional view of the mattress tray assembly shown in FIG. 18, taken at detail point Z in FIG. 19C.
Figure 19C:
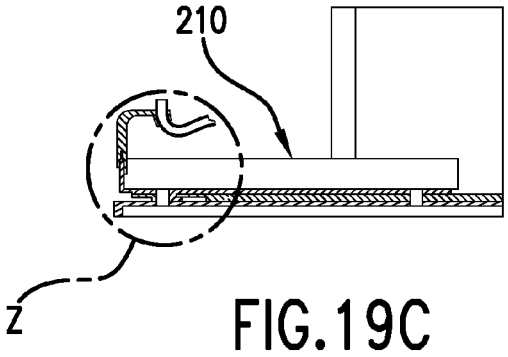
FIG. 19C is a side cross-sectional view of the mattress tray assembly shown in FIG. 18, taken along lines I-I shown in FIG. 19B.

FIG. 18 shows a mattress tray assembly 200 according to a third exemplary embodiment of the present invention. One of the differences between the mattress tray assembly 200 and the mattress tray assemblies 40 and 140 described above is the ability to rotate about four (4) separate axes of rotation. One of the advantages of using four axes of rotation is the possibility of rotating the mattress tray 210 three hundred sixty degrees (360°) or more with only one side wall (e.g., side wall 48 in FIG. 1) of the warming therapy device open. Another advantage is the ability to rotate the mattress tray 210 ninety degrees (90°) without changing hoses, cables or other connections (e.g., hose 260) to an infant patient disposed on the mattress tray.

The mattress tray assembly 200 includes a mattress tray 210, support base 220, side was 230, and end walk 240. The mattress tray assembly 200 may also include a stress relief 250 for holding a hose 260, or the like. The mattress tray 210 may be formed of any suitable shape, and is formed in a rectangular shape with rounded corners in the exemplary embodiment. The radii of the rounded corners oldie mattress tray 210 may be defined by the condition of non-interference with the side walls 230. The mattress tray 210 is attached to the support base 220 through legs 215 which slide within grooves 225 in the support bask (See FIGS. 20A-20C and 21A-21C). As shown in FIGS. 21A-21C (discussed below), the mattress tray assembly 200 may include at least four (4) such grooves 225, each of which are arcuate in shape. As noted above, the mattress tray 210 and the support base 220 are surrounded by side and end walk 230, 2410, which may be opened, displaced or removed. One of the purposes of the side and end walls 230, 240 is to substantially prevent the infant patient disclosed on the mattress tray 210 from falling off the mattress tray assembly 200.

As will be noted by those of ordinary skill in the art, the mattress tray assembly 200 according to the third exemplary embodiment may of the present invention be integrated into a warming therapy device, such as the one shown in FIG. 1. For example, the mattress tray 210 equates to the mattress tray 41 shown in FIG. 1.

With further reference to FIG. 18, the stress relief 250 operates to fix the hose 260 relative to the mattress tray 210. This is beneficial in that when an infant patient disposed on the mattress tray 210 is coupled to a medical hose (e.g., ventilator hose), there will be little or no strain on the hose when the mattress tray 210 is moved relative to the support base 220, as explained below.

The rotation of the mattress tray 210 within the support base 220 may be restricted to only one axis of rotation by inserting a stop 270. The stop 270 may comprise a hollow cylindrical tube which is adapted to lie within circular access holes formed in the mattress tray 210 and the support base 220, which are described below. The stop 270 may also be used as a conduit for hoses and electrical connectors. The stop 270 operates to fix rotation around a particular axis without the need to realign hose or connectors coming through stress relief 250, or the stop 270. In particular, because the hoses and/or connectors will be coining through the axis of rotation, they will not experience any changes that will alter the required connector and/or hose length.

FIGS. 19A-19D show further details of the mattress tray assembly 200. As noted above the mattress tray 210 may be attached to the support base 220 using four (4) legs 215 which slide inside grooves 225 in the support base.

Figure 20A:
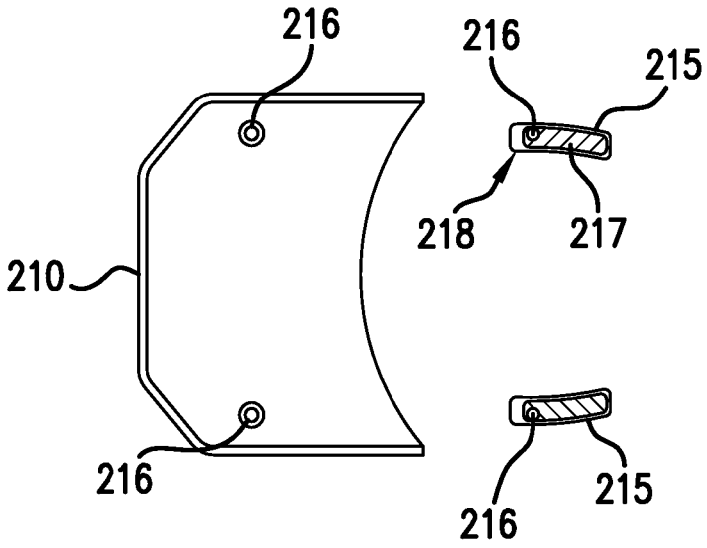
FIG. 20A is a top view of a mattress tray according to a third exemplary embodiment of the present invention.
Figure 20B:
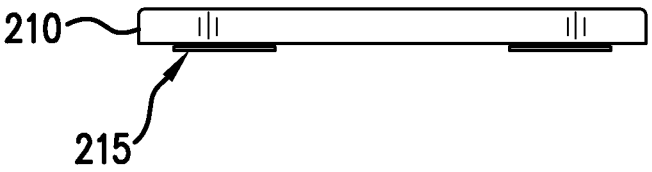
FIG. 20B is a side view of the mattress tray shown in FIG. 20A.
Figure 20C:
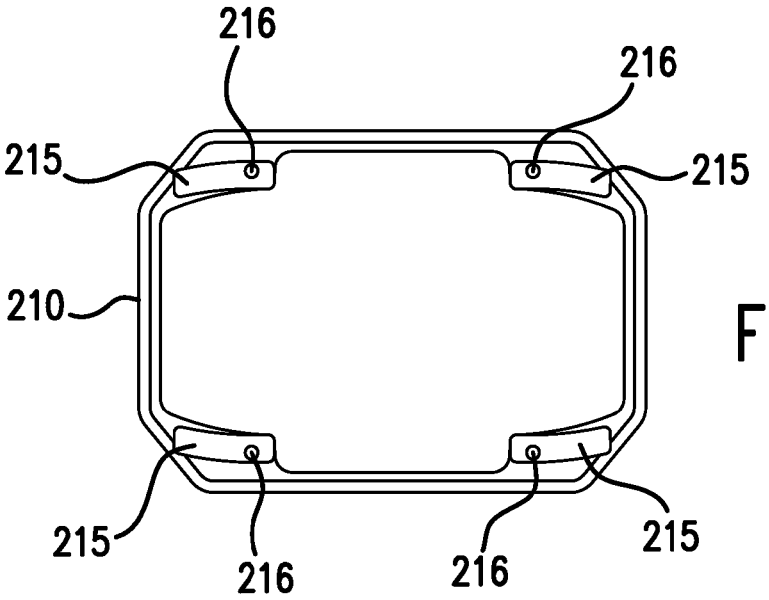
FIG. 20C is a bottom view of the mattress tray shown in FIG. 20A.
Figure 21A:
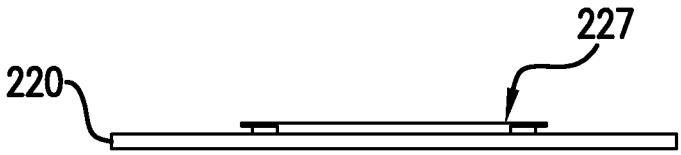
FIG. 21A is a side view of a support base according to a third exemplary embodiment of the present invention.
Figure 21B:
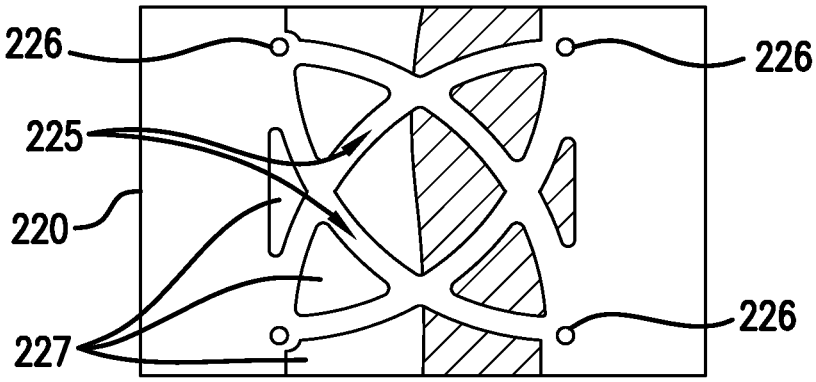
FIG. 21B is a top view of the support base shown in FIG. 21A.
Figure 21C:
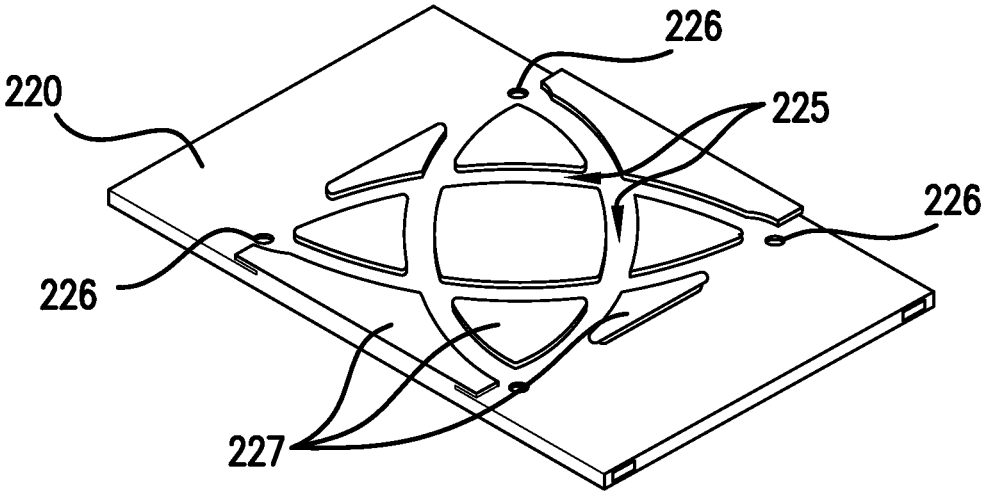
FIG. 21C is a perspective view of the support base shown in FIG. 21A.

FIGS. 20A-20C show further details of the legs 215 formed in the mattress tray 210. Each of the legs 215 may include an access hole 216 which are coaxial with each of the four (4) axes of rotation for the mattress tray 210. FIG. 20A is a top view of the mattress tray 210 which is partially cut away to show the orientation of the legs 215 on the underside of the mattress tray. Each of the legs 215 is roughly arc-shaped and includes an upper portion 217 and a lower portion 218. The lower portion 218 is adapted to slide within grooves 225 in the support base 220 (as discussed below), and the upper portion is adapted to provide a connection to the main body of the mattress tray 210 and provide a space therebetween. FIG. 20B is a side view of the mattress tray 210, showing the position of the legs 215 underneath. FIG. 20C is a bottom view of the mattress tray 210, showing the position of each of the legs 215, and access holes 216.

FIGS. 21A-21C show further details of the grooves 225 formed in the support base 220. The support base 220 includes access holes 226, which cooperate with the access holes 216 in the mattress tray 210, and which are coaxial with each of the four (4) axes of rotation for the mattress tray. FIG. 21A is a side view of the support base 220, showing the grooves 225 which are formed by a plurality of raised members 227. FIG. 21B is a top view of the support base 220, partially cut away and showing the positions of the raised members 227 and the access holes 226. FIG. 21C is a perspective view of the support base 220, showing the orientation of the grooves 225, access holes 226, and raised members 227.

Figure 22A:
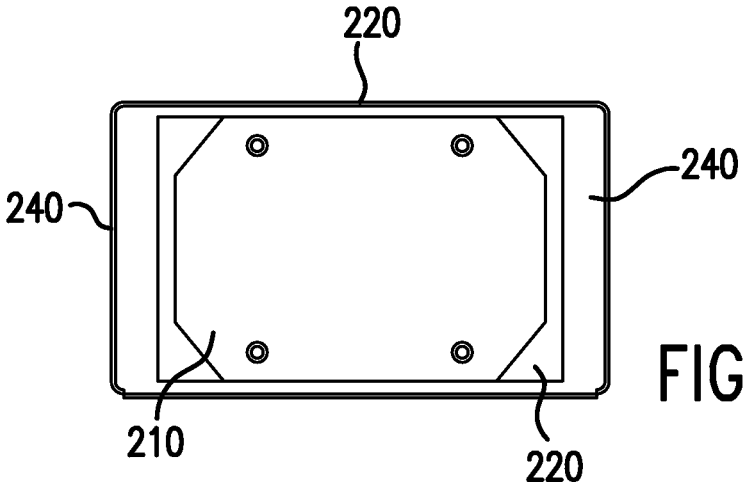
FIG. 22A is a top view of a mattress tray assembly according to the third exemplary embodiment of the present invention, where the mattress tray is disposed in a central position.

The mattress tray 210 may be attached to, or removed from, the support base 220 only in one position when all four (4) axes of rotation of the tray are aligned with the access holes 226, which corresponds to the standard position of the mattress tray (i.e., the position where the mattress tray is aligned with support base, shown in FIG. 22A). Once the mattress tray 210 is rotated about one (1) of the four (4) axes of rotation it cannot be removed from the support base 220, because one or more of the legs 215 will be fixed inside one or more of the grooves 225.

Figure 22B:
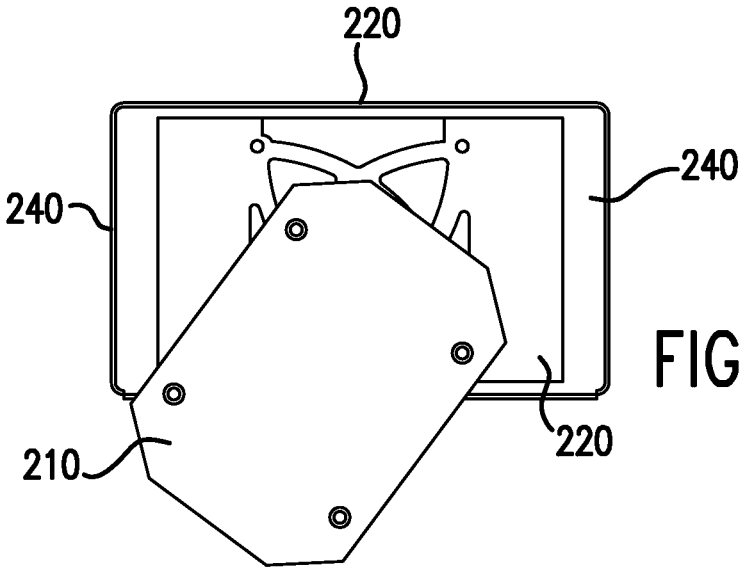
FIG. 22B is a top view of the mattress tray assembly shown in FIG. 22A, where the mattress tray is disposed in a first rotated position which is rotated approximately forty-five degrees (45°) with respect to the central position.
Figure 22C:
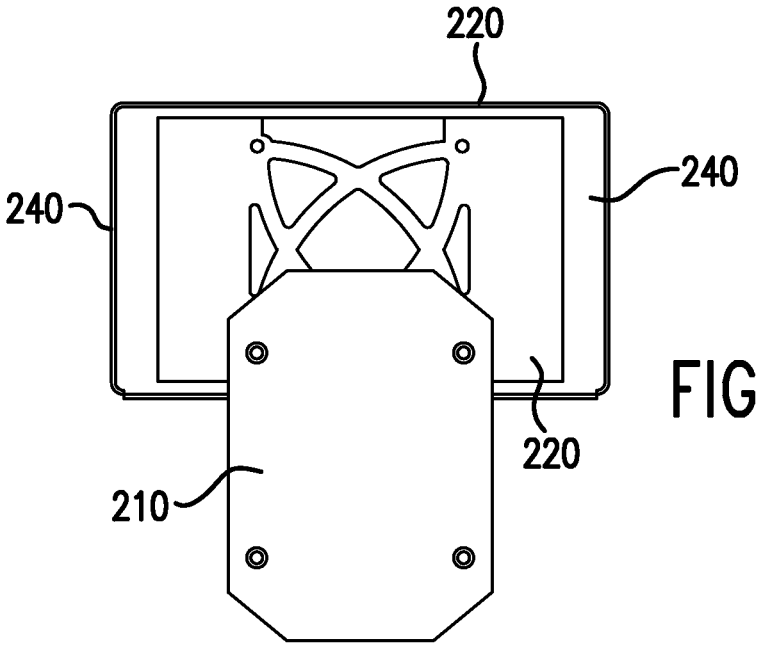
FIG. 22C is a top view of the mattress tray assembly shown in FIG. 22A, where the mattress tray is disposed in a second rotated position which is rotated approximately ninety degrees (90°) with respect to the central position.
Figure 22D:
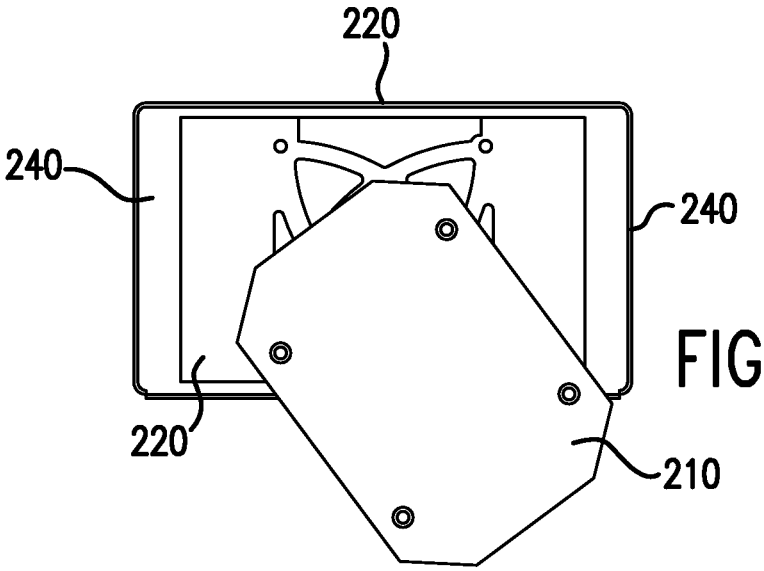
FIG. 22D is a top view of the mattress tray assembly shown in FIG. 22A, where the mattress tray is disposed in a third rotated position which is rotated approximately one hundred thirty five degrees (135°) with respect to the central position.
Figure 22E:
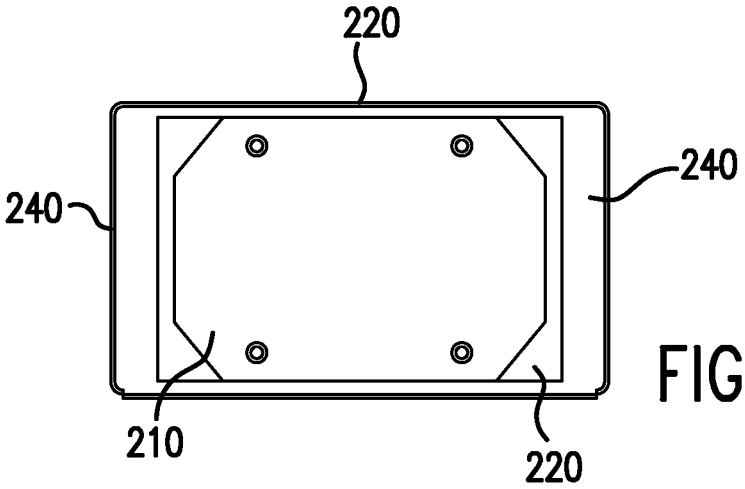
FIG. 22E is a top view of the mattress tray assembly shown in FIG. 22A, where the mattress tray is disposed in a fourth rotated position rotated approximately one hundred eighty degrees (180°) with respect to the central position and which is the same as the central position shown in FIG. 22A).

FIGS. 22A-22E show possible positions of the mattress tray 210 when only one side wall 230 is opened. FIG. 22A is a top view of the mattress tray assembly 200 according to the third exemplary embodiment, where the mattress tray 210 is disposed in a first (e.g., standard) position. FIG. 22B shows the mattress tray 210 in a second exemplary position which is rotated approximately forty-five degrees (45°) with respect to the first position shown in FIG. 22A. FIG. 22C shows the mattress tray 210 in a third exemplary position which is rotated approximately ninety degrees (90°) with respect to the first position. FIG. 22D shows the mattress tray 210 in a fourth exemplary position which is rotated approximately one hundred thirty five degrees (135°) with respect to the first position. Finally, FIG. 22E shows the mattress tray 210 in a fifth exemplary position which is rotated approximately one hundred eighty degrees (180°) with respect to the first position.

FIGS. 6A through 6C show that the mattress tray 210 can be turned 90 degrees (90°) using only one (1) axis of rotation. In particular, the mattress tray 210 is rotated about the axis of rotation corresponding to the access hole 216 in the lower right-hand corner of the mattress tray as shown in FIG. 6A. Once the mattress tray 210 is in the position shown in FIG. 6C it is possible to rotate the mattress tray around another axis of rotation to complete a one hundred eighty degree (180°) turn, as shown in FIGS. 6D and 6E. In particular, the mattress tray 210 is rotated about the axis of rotation corresponding to the access hole 216 in the lower left-hand corner of the mattress tray as shown in FIG. 6A. Those of ordinary skill will realize that the above-described exemplary positions and axes of rotation are for explanatory purposes only, and that various positions of the mattress tray 210 are achievable using the four (4) axes of rotation provided by the mattress tray assembly 200.

Although the mattress tray assemblies 40, 140 and 200 according to the first through third exemplary embodiments are shown and described above with reference to an associated warming therapy device 10, those of ordinary skill in the art will realize that any of the mattress tray assemblies 40, 140 and 200 may be integrated into any suitable incubator, warmer, or other equivalent apparatus. Further, although the mattress tray assemblies 40, 140 and 200 according to the first through third exemplary embodiments are shown and described above with up to four (4) axes of rotation, those of ordinary skill in the art will realize that mattress tray assemblies including any number of axes of rotation e.g., 1, 2, 3, 4 or more) are encompassed within the scope of the present invention.

Although the invention has been described in terms a exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

The invention claimed is:

1. An apparatus comprising:

a patient support assembly; and, a mattress tray assembly coupled to the patient support assembly, the mattress tray assembly comprising a mattress tray and a support base, the mattress tray being moveable within the support base about at least two axes of rotation, wherein the mattress tray includes at least four legs coupled thereto which are adapted to fit within at least four grooves formed in the support base, such that a first two of the at least four grooves are symmetrical to each other and to a central axis of the support base, and a second two of the at least four grooves are symmetrical to each other and to a central axis of the support base, and wherein the mattress tray is rotatable approximately three hundred and sixty degrees (360°) relative to the support base.

2. The apparatus of claim 1, wherein at least two of the at least four grooves are circular in shape.

3. The apparatus of claim 2, wherein the at least two circular grooves intersect each other.

4. The apparatus of claim 1, wherein the at least two axes of rotation comprise at least four axes of rotation.

5. The apparatus of claim 1, further comprising a stress relief coupled to the mattress tray.

6. The apparatus of claim 1, wherein at least two of the at least four grooves are arcuate in shape.

7. The apparatus of claim 1, wherein at least one of the at least four legs includes at least one access hole disposed therein.

8. The apparatus of claim 7, wherein the support base includes at least one access hole which cooperates with the at least one access hole disposed in the at least one of the at least four legs.

9. A warming therapy device comprising:

a patient support assembly;

a mattress tray assembly coupled to the patient support assembly, the mattress tray assembly comprising a mattress tray and a support base, the mattress tray being moveable within the support base about at least two axes of rotation; and a hood coupled to the patient support assembly, said hood including at least one sidewall, wherein the mattress tray includes at least four legs coupled thereto which are adapted to fit within at least four grooves formed in the support base, such that a first two of the at least four grooves are symmetrical to each other and to a central axis of the support base, and a second two of the at least four grooves are symmetrical to each other and to a central axis of the support base, and wherein the mattress tray is rotatable approximately three hundred and sixty degrees (360°) relative to the support base.

10. The warming therapy device of claim 9, wherein the at least one sidewall comprises at least four sidewalls, and wherein the mattress tray is rotatable approximately three hundred and sixty degrees (360°) within the support base with only one of the at least four sidewalls removed.

11. An apparatus comprising:

a mattress tray; and, a support base, wherein the mattress tray is moveable within the support base about at least two axes of rotation to at least first and second positions, the first position being substantially centered on the support base, and the second position being located laterally on one side of the first position, wherein the mattress tray includes at least four legs coupled thereto which are adapted to fit within at least four grooves formed in the support base, such that a first two of the at least four grooves are symmetrical to each other and to a central axis of the support base, and a second two of the at least four grooves are symmetrical to each other and to a central axis of the support base, and wherein the mattress tray is rotatable approximately three hundred and sixty degrees (360°) relative to the support base.

* * * * *